United States Patent [19]

Sterbutzel

[11] 4,282,813

[45] Aug. 11, 1981

[54] TWO PIECE CASELESS ROUND AND GUN THEREFOR

[75] Inventor: Gerald A. Sterbutzel, Bowmansville, N.Y.

[73] Assignee: Calspan Corporation, Columbus, Ind.

[21] Appl. No.: 970,086

[22] Filed: Dec. 15, 1978

[51] Int. Cl.[3] ..... F42B 5/02

[52] U.S. Cl. ..... 102/431

[58] Field of Search ..... 102/38 R, 38 CC, 105

[56] References Cited

U.S. PATENT DOCUMENTS

| | | | |
|---|---|---|---|
| 3,496,827 | 2/1970 | Dardick . | |
| 3,628,456 | 12/1971 | Harrell . | |
| 3,770,563 | 11/1973 | Bobinski et al. | 102/38 CC X |
| 3,877,374 | 4/1975 | Cook | 102/38 CC X |
| 3,901,153 | 8/1975 | Brabets et al. | 102/38 CC X |
| 4,023,996 | 5/1977 | Leneveu | 102/38 X |
| 4,123,963 | 11/1978 | Junker . | |

*Primary Examiner*—Peter A. Nelson

*Attorney, Agent, or Firm*—Biebel, French & Nauman

[57] ABSTRACT

The projectile and propellant portions of two-piece cartridge are separately fed to a gun. In one embodiment, the gun is of the type having a cylinder defining a plurality of chambers and a single barrel. The cylinder rotates through a number of positions during each revolution during which the projectile and propellant portions of a cartridge are separately loaded into each chamber, the cartridge is fired and the chamber is cleared.

2 Claims, 10 Drawing Figures

TWO PIECE CASELESS ROUND AND GUN THEREFOR

The gun system design for an air superiority fighter poses challenging problems due to the inherent weight and space limitations as well as the vulnerability of the ammunition to detonation from hostile gunfire. The rewards in weight and space savings are high, however, for an efficient, well-designed system which can be much lighter than present systems. Likewise, the space requirements are large and usually compete with other aircraft systems for high priority space within the aircraft and it is desirable to locate ammunition boxes near the aircraft center of gravity to minimize changes of trim resulting from reduced load during combat.

Caseless and telescoped rounds each offer cost and weight savings when compared to conventional brass-cased rounds. Telescoped ammunition, additionally, presents stacking advantages and offsetting feed problems due to its non-tapering cylindrical shape. Conventional caseless ammunition has the disadvantages of being more fragile, less weight balanced and in presenting heat transfer problems. Caseless ammunition does, however, lend itself to innovations requiring a new gun system where the caseless ammunition is made in two pieces—the projectile and propellant, respectively. Various combinations are possible, but a revolver-type of gun mechanism having a plurality of chambers and a single barrel is preferred. In this type of gun mechanism, each chamber sequentially passes through several stages during each revolution during which the projectile and propellant are separately loaded into the chamber, the round is fired and the chamber is cleared.

It is an object of this invention to provide a two-piece round and a gun mechanism therefor.

It is an additional object of this invention to provide a gun mechanism having a shortened ramming distance and a reduced acceleration.

It is a further object of this invention to reduce the storage risk of ammunition by providing a two-piece round having separately storable parts to reduce vulnerability to detonation.

It is an additional object of this invention to provide a light-weight cannon and ammunition therefor.

It is a still further object of this invention to provide a caseless round in which the relatively fragile propellant charge can be injected as a monolithic light mass with very little inertia.

It is an additional object of this invention to provide a more efficient and lighter caseless round which leaves negligible unburned propellant.

It is a yet still further object of this invention to provide propellant and projectile packages which are relatively easily transported and which require a minimal storage volume.

It is an additional object of this invention to provide a cartridge made up of a selectable projectile portion and a selectable propellant portion.

It is a further object of this invention to provide a completely encapsulated propellant unit having a plastic film which is readily removable from the weapon environs with minimal fouling. These objects, and others as will become apparent hereinafter, are accomplished by the present invention.

A major problem associated with caseless ammunition concerns the burning boundary layer adjacent to the chamber wall. In this situation not only are the cooling and heat ejection functions of a normal brass case lacking, but in addition, there exists a highly convective boundary layer with an extremely large temperature difference between the chamber wall and the gun. A covering can be used for environmental protection of the combustible components but, in addition, a covering can be used to diminish heat transfer into the chamber. Difficulties, however, have been encountered in residue from film coverings. These difficulties have been circumvented by limiting the thickness of the covering and the area on which it is applied but the amount of heat protection given the chamber is also limited.

Basically, in the preferred embodiment, the gun mechanism is of the revolving drum type with a plurality of chambers and the gun has a single barrel. The caseless two-piece rounds are made up of projectiles and propellant, respectively, which are separately fed into the respective chambers at different rotational positions of the chambers. The propellant charge together with an ablative capsule is completely encapsulated with an approximately 5-mil thick film polyester covering which upon firing of the round will shrink away from the chamber wall to facilitate its removal by propellant gases or, when necessary, by ram or bleed air at the next chamber position.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
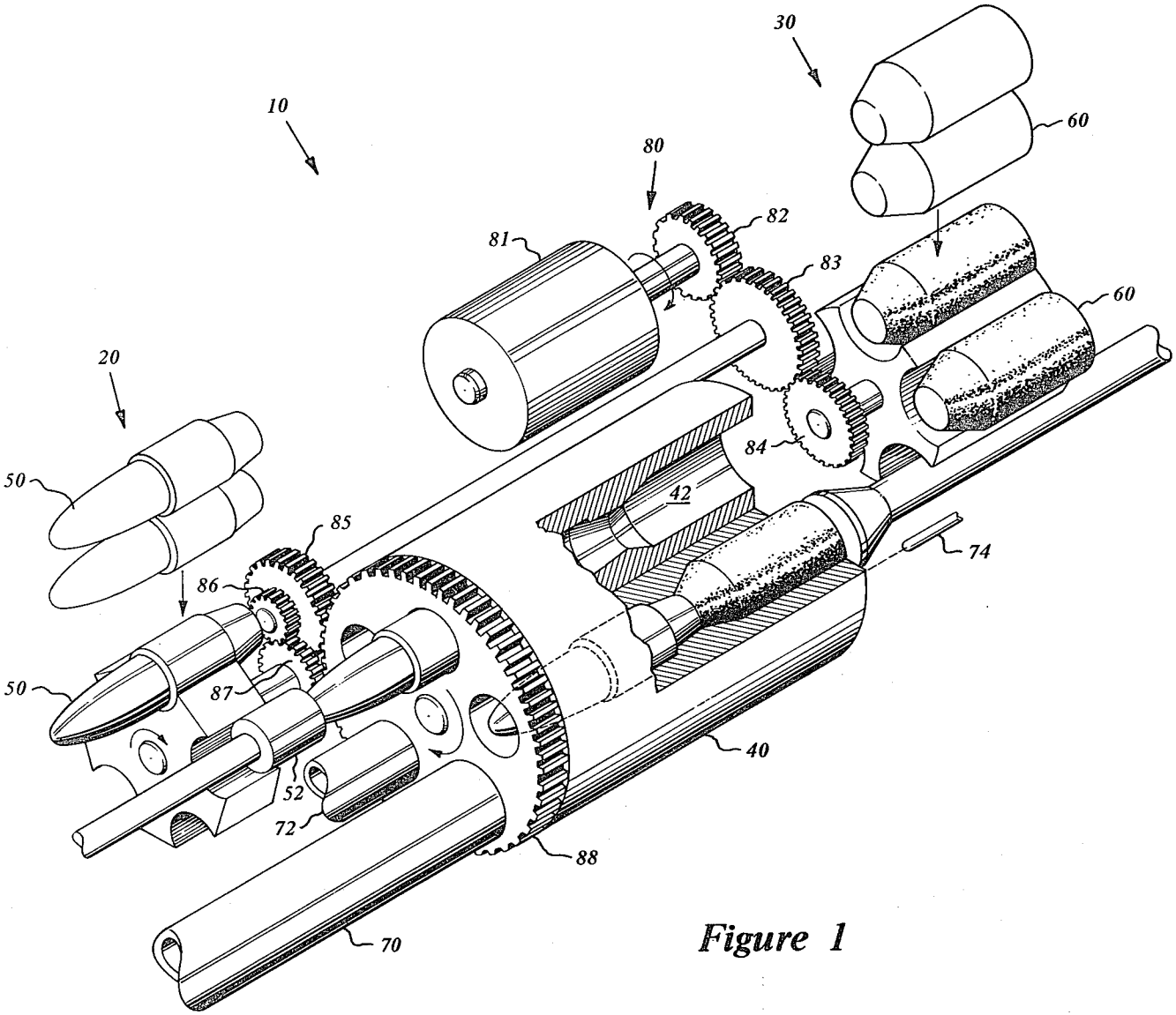
FIG. 1 is a simplified, cutaway, pictorial representation of the gun and feed mechanisms.

Referring to FIG. 1, the numeral 10 generally designates the gun of the present invention. Gun 10 differs from conventional guns in the use of two-piece cartridges and the necessary provision of separate feed mechanisms, 20 and 30, for the projectiles and propellant portions, 50 and 60, respectively, of the two-piece cartridges. Cylinder 40 contains a plurality of chambers 42 and is located intermediate feed mechanisms 20 and 30. Barrel 70 and blow-by passage 72 have ends which are coaxial with respective predetermined positions of chambers 42 of the cylinder 40. Firing pin 74 is coaxial with the barrel 70. The feed mechanisms 20 and 30 and the cylinder 40 are powered through a motor driven gear train which is generally designated 80. The motor driven gear train 80 includes gears 82–88 which are driven in steps by motor 81 to cause the chambers 42 to stop at the illustrated positions and to cause the feed systems 20 and 30 to advance the projectiles 50 and propellant 60, respectively, to their proper feed positions.

Figure 2:
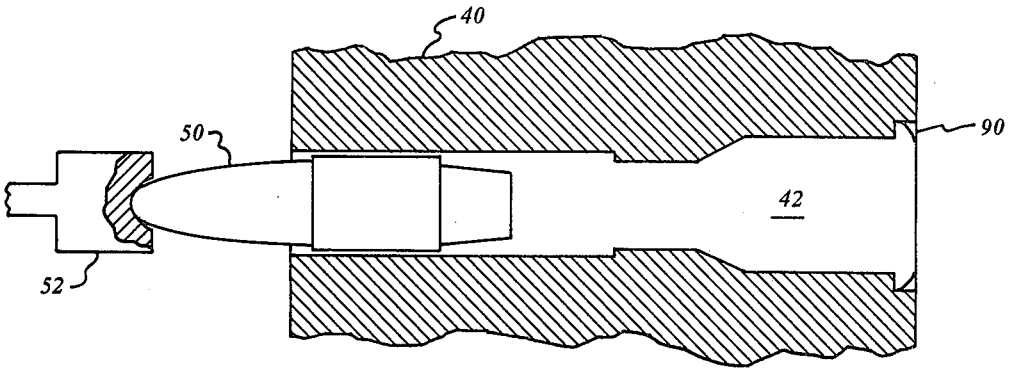
FIG. 2 is a sectional view showing the projectile feed.
Figure 3:
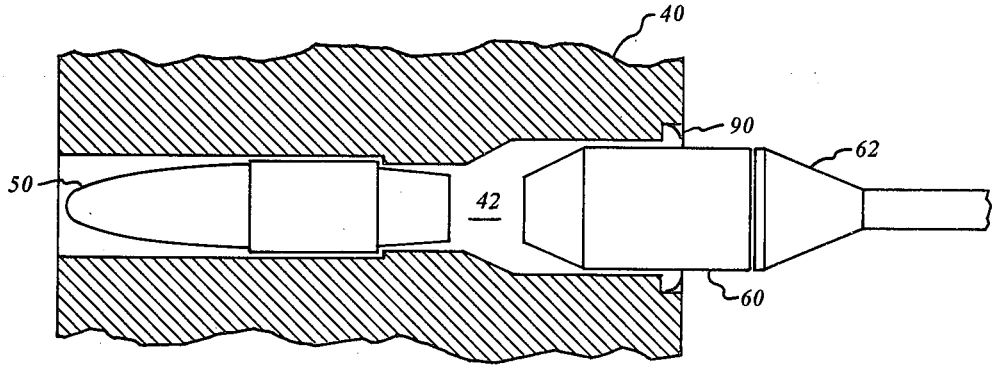
FIG. 3 is a sectional view showing the propellant feed.
Figure 4:
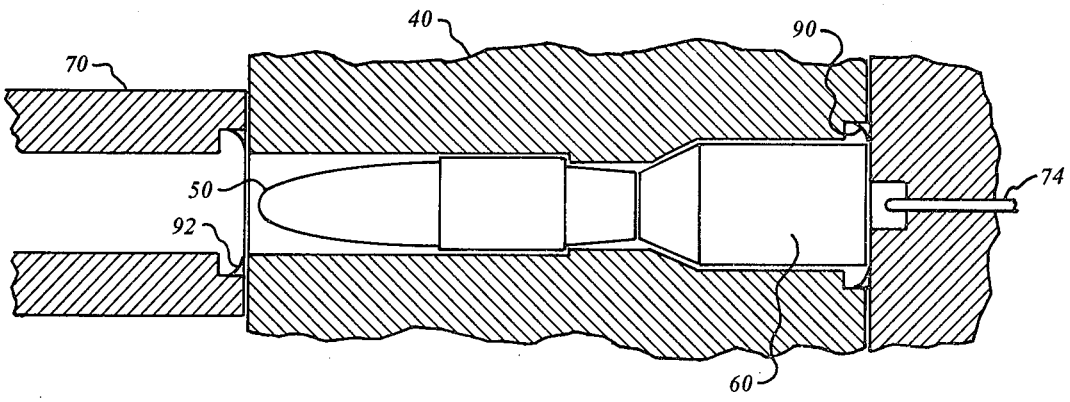
FIG. 4 is a sectional view showing the loaded cartridge in the firing chamber of the gun mechanism.

The sequence of operation is best shown in FIGS. 2–5 which each represent a step in the rotation of cylinder 40. Referring first to FIG. 2, the projectile 50 is loaded into the chamber 42 of cylinder 40 by suitable conventional feed means which have been represented by ram driven piston 52. Projectile 50 will be loaded into chamber 42 and the chamber 42 will be moved to the FIG. 3 position via the rotation of cylinder 40. In the FIG. 3 position, propellant 60 is loaded into chamber 42 by suitable conventional feed means which have been represented by piston 62 and the chamber 42 will be moved to the FIG. 4 position via the rotation of cylinder 40. FIG. 4 is the firing position and when conventional firing pin 74 strikes the primer of propellant 60, propellant 60 and projectile 50 coact in the manner of a conventional one-piece round. After firing, the chamber 42 is rotated to the FIG. 5 position. Where caseless ammunition is used, the possibility that the chamber may contain a small amount of residue such as unburned propellant is eliminated by ram or bleed air supplied via blow-by passage 72. Chamber 42 will then be ready to be returned to the FIG. 2 position to repeat the process.

Figure 6:
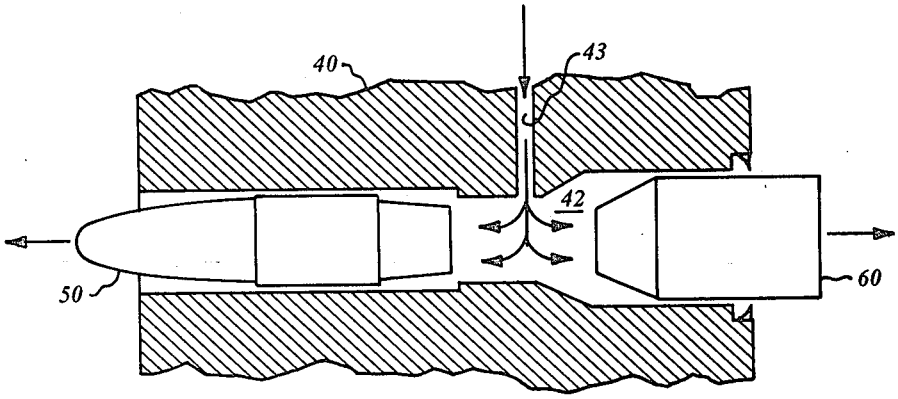
FIG. 6 is a partial sectional view showing the removal of the projectile and propellant from the chamber.

Because the projectile 50 and the propellant 60 are loaded from opposite ends of chambers 42 of cylinder 40, the unloading of the chambers 42 can present difficulties. In order to force the projectile 50 and propellant 60 out of chamber 42, a source of pressurized air may be communicated with chambers 42 via a passageway 43 as shown in FIG. 6. The source of pressurized air may be the ram air or a gas producing charge may be fired to supply pressurized gas. In any event a check valve (not illustrated) or equivalent structure would be used to prevent the escape of gases produced by the burning of propellant 60 via passageway 43. Conventional mechanisms can be used to complete the removal.

Figure 7:
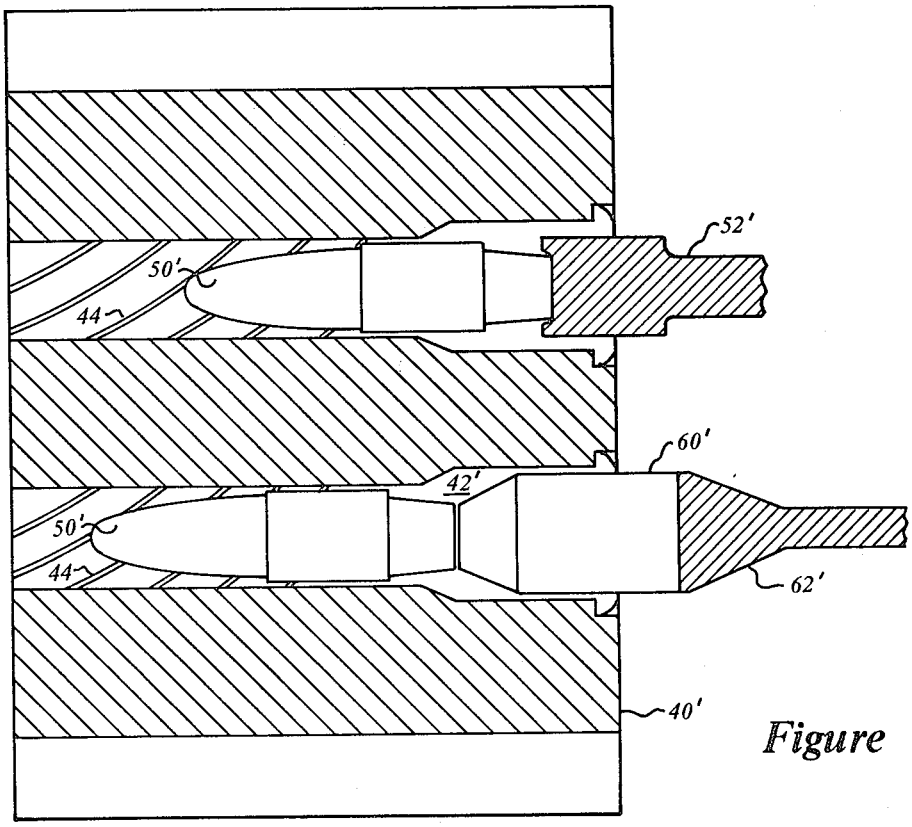
FIG. 7 is a partial sectional view of a first modified gun.

Referring now to FIG. 7, a gun mechanism is shown for use with a smooth bore barrel. A prime has been added to the numbers used to label corresponding structure in FIGS. 1–6. In this modification, the projectile 50' and propellant 60' are sequentially loaded into chamber 42' from the same side of cylinder 40'. Projectile 50' is loaded into chamber 42' by suitable conventional feed means which have been represented by piston 52'. Propellant 60' is subsequently loaded into chamber 42' by suitable conventional feed means which have been represented by piston 62'. In loading the propellant 60', the projectile 50' is pushed farther into the chamber 42'. The muzzle end of the walls of the chamber 42' are provided with rifling 44.

Figure 8:
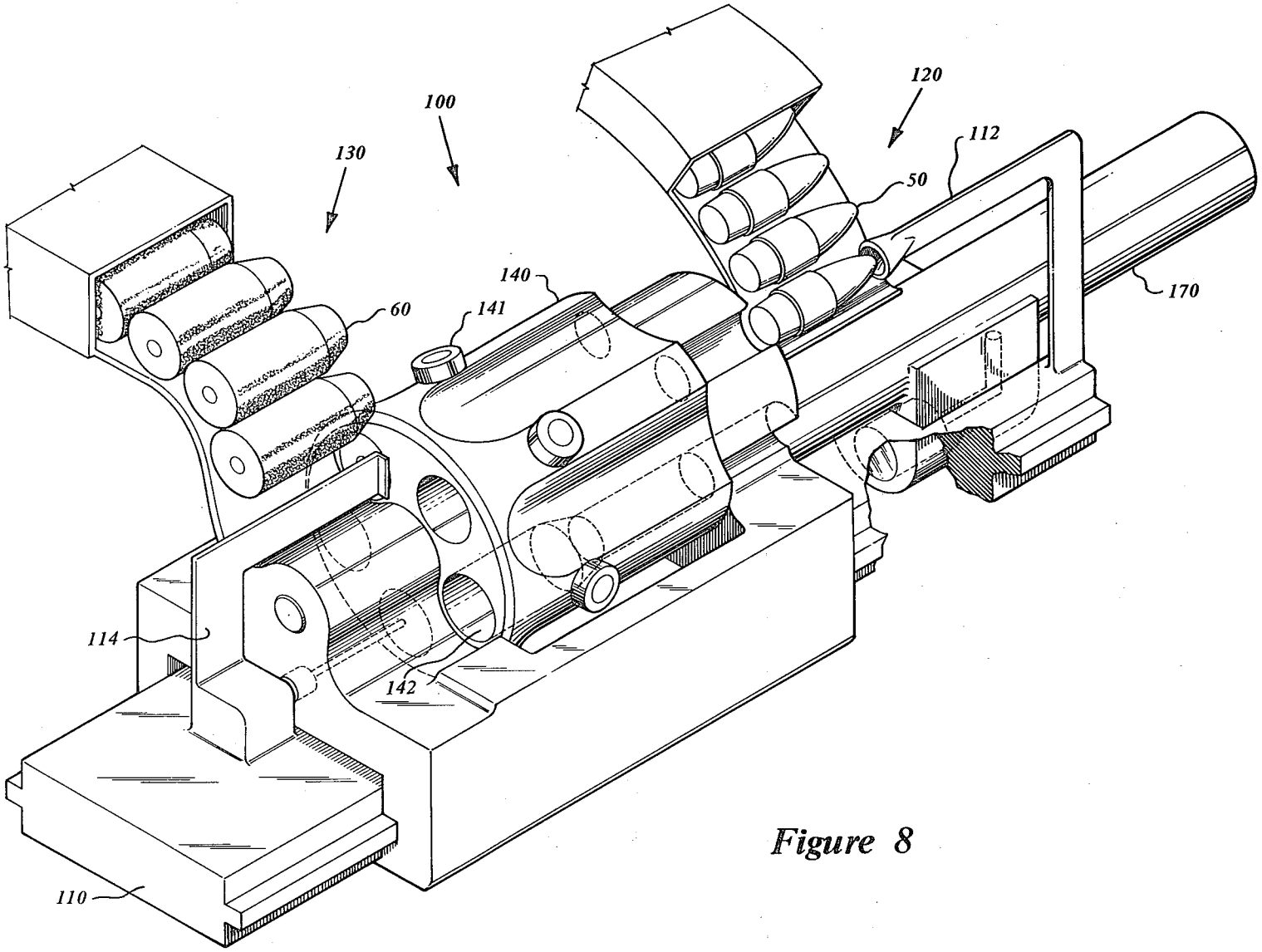
FIG. 8 is a simplified, cutaway, pictorial representation of a second modified gun.

In FIG. 8, the numeral 100 generally designates a gas operated gun mechanism. The high pressure gases produced by the burning of the propellant 60 are bled off from the barrel 170 to cause the rearward movement of member 110 followed by forward movement due to inertia and/or a spring. The member 110 has feeder members 112 and 114 located at opposite ends thereof and coacting with projectile and propellant feeds 120 and 130, respectively, to load the chambers 142 of cylinder 140.

Figure 9:
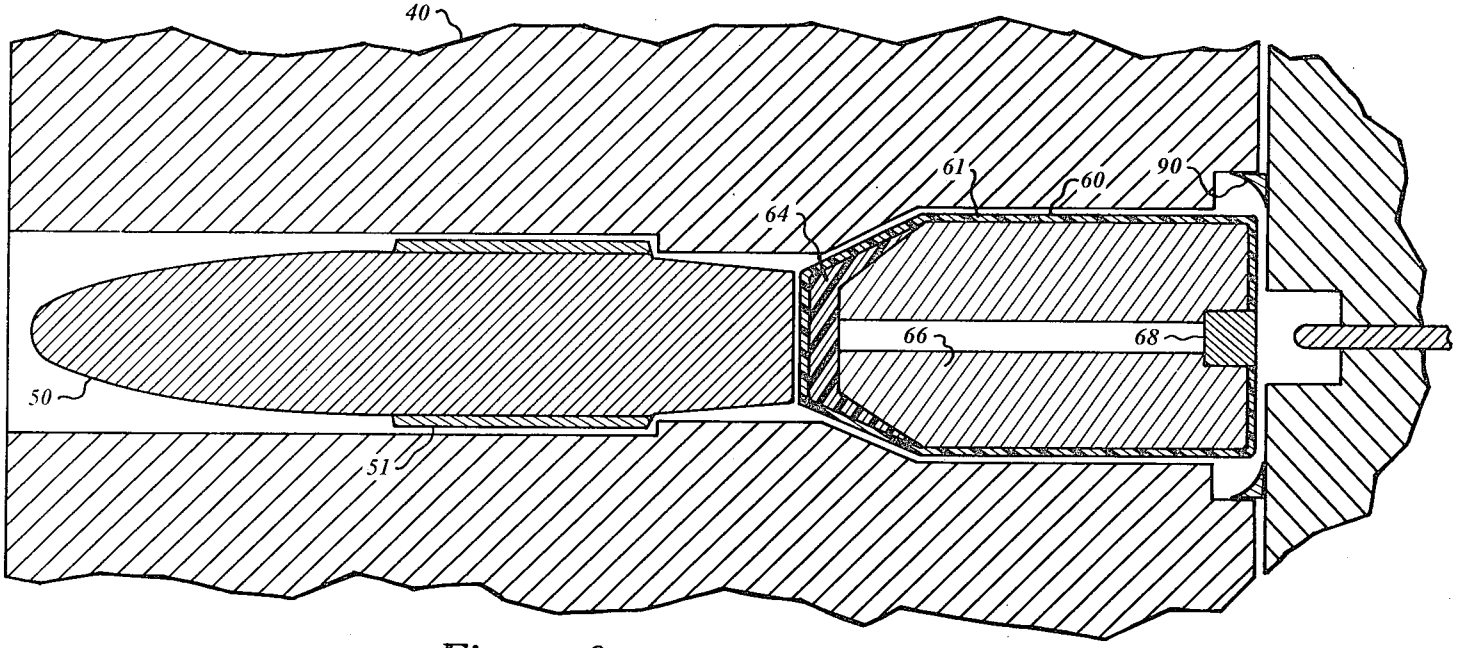
FIG. 9 is a sectional view showing a two-pieced caseless cartridge in the firing chamber of a gun mechanism.

As best shown in FIG. 9, the preferred embodiment of the ammunition is made up of projectile 50 and propellant 60. Projectile 50 has a plastic rotating band 51 located thereon. The propellant 60 is covered with a heat-shrinkable polyester film 61 such as Mylar approximately 0.005 inches thick. The propellant 60 includes ablator 64, propellant charge 66 and primer 68 as an integral unit. The ablator 64 will ordinarily be encapsulated and in the form of a gel.

Figure 10:
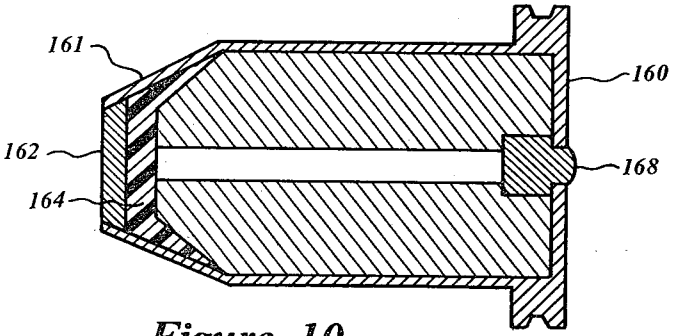
FIG. 10 is a sectional view of the propellant portion of a two-piece cased cartridge.

A cased shell may be made according to the teachings of the present invention as best shown in FIG. 10. The projectile would be the same as that used for a caseless two-piece cartridge. The propellant 160 is cased with a casing 161 and is closed with a wad 162, as illustrated, or a metal foil seal. Within the casing 161 is an ablator 164, a propellant charge 166 and a primer 168.

The ablators 64 and 164 are a silicone material such as dimethyl silicone. The ablators will ordinarily be encapsulated in or separated from the propellant charge by a diaphragm of an impervious material such as cellulose acetate or else gelled by mixing with 5–10% of fumed silica. By gelling or encapsulating the ablator, the viscosity of the ablator may be as low as 1000 centistokes and range up to 2,500,000 centistokes.

OPERATION

In the operation of the gun 10, each revolving chamber 42 of the cylinder 40 is driven in steps by motor driven gear train 80 through the sequence of positions illustrated in FIGS. 2–5. The appropriate chamber(s) 42 may be loaded with the required projectile(s) 50 and/or propellant 60 as part of the pre-flight preparation of the airplane carrying the gun 10 or the propellant feed 30 may be separately operated to insure that a propellant 60 is always present when there is a projectile 50 in the firing chamber. In operation, power to operate the feed mechanisms 20 and 30, to rotate the cylinder 40 and to clear the chambers 42 after firing will be available from the high pressure gases produced upon firing as well as from the engine ram or bleed air and will use conventional techniques and structure. As illustrated in FIG. 1, this power drives motor 81 which in turn causes cylinder 40 to stepwise rotate through the coaction of gears 82, 83, 85 and 88 but any suitable conventional techniques and structure may be used. When the gun 10 is fired, all of the steps illustrated in FIGS. 2–5 will be taking place simultaneously in respective chambers. For any one chamber 42, the sequence of steps will be those of FIGS. 2–5 during which the sequential steps of loading projectile 50, loading propellant 60, firing the two-piece cartridge made up of projectile 50 and propellant 60 and clearing the chamber 42 will take place. In the firing step of FIG. 4, the firing pin 74 strikes the primer and causes the propellant charge to ignite. Because the sealing operation of conventional guns is usually carried out by the use of a metal case, ring seals 90 and 92 are provided. Ring seals 90 and 92 have flared edges which have the capability of flexing against conforming areas. In the instant in which the high pressure is generated in the chamber 42, the semi-feathered edge flexes against the smooth surface to perform the sealing function. As soon as the gas pressure is lowered, the bearing pressure at the feathered edge is released, permitting a cycling operation for the next round. If desired, or necessary the firing pin 74 may be similarly sealed. The covering film of heat-shrinkable polyester shrinks away from the chamber wall when the round is fired thereby reducing heat input into the chamber 42 and "balls up" and usually disappears. The film tends to maintain integrity at the chamber wall long enough to leave a clean chamber and to avoid chamber fouling. The high pressure gases produced by the burning propellant force the projectile 50 and ablator ahead of it. The ablator 64 coats the front part of the wall of the chamber 42 as well as the walls of the barrel 70 thereby diminishing the heat transferred into the front of the cylinder 40 and into the barrel 70.

Figure 5:
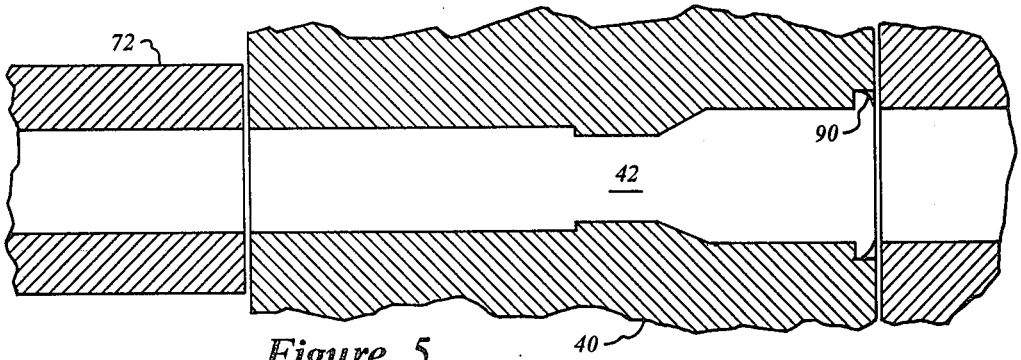
FIG. 5 is a sectional view showing the clearing of the chamber.

After the round is fired, the chamber 42 is rotated to the FIG. 5 position. Where a caseless cartridge is used, only the balled up film, if anything, will remain in the chamber 42 and will be readily removed by bleed or bypass air supplied via blow-by passage 72. Where a brass cased propellant 160 is used, as to obtain additional heat removal via the heated casing, bleed or bypass air may be used but conventional ejection structure would be preferred.

If the propellant 60 fails to ignite and thereby jams the gun, or if no live ammunition is desired in the firing chamber, the projectile 50 and propellant 60 may be removed from chamber 42 as shown in FIG. 6. All of the chambers 42 would be cleared while the feed mechanisms 20 and 30 were deactivated since the clearing and firing positions are different.

The operation of the gun mechanism of FIG. 7 will be the same as that of FIG. 1 except that the projectile 50' and propellant 60' will be loaded from the same side and the rifling 44 will only be in the cylinder 40'.

The operation of the gun mechanism 100 of FIG. 8 is similar to that of the conventional M-39 gun other than for the separate propellant and projectile feeds. When in operation, member 110 reciprocates with feeder member 112 causing the feeding of a projectile 50 on the rearward portion of the stroke followed by feeder member 114 causing the feeding of a propellant 60 on the forward portion of the stroke. Power for the operation of gun mechanism 100 is supplied by bleeding off a portion of the high pressure gases produced by the burning of propellant 60 as is conventional. Indexing members 141 are located on cylinder 140 and coact with cam members (not illustrated) to cause the step-wise rotation of the cylinder 140 on the rearward movement of member 110.

Except for being in two pieces, the cartridges of FIGS. 9 and 10 function the same as conventional caseless and cased rounds, respectively.

Although the present invention has been described in terms of aircraft armaments where weight is an overriding consideration, it may also be advantageously applied to other armament systems. For example, the present invention may be employed with large guns such as the self-propelled guns. Such guns have a single chamber and automatic loading structure and could be adapted to employ the present invention. In addition, the present invention would make caseless ammunition a viable option in such a system. It is therefore intended that the scope of the present invention is to be limited only by the scope of the appended claims.

I claim:

1. A two-piece non-telescoped caseless cartridge including a projectile portion and a propellant portion which are separately fed to a firing chamber of a gun, said propellant portion including:

a shaped propellant charge;

an ablator material disposed at an end portion of said propellant charge adjacent said projectile; and a heat shrinkable polyester film encapsulating said propellant charge and said ablator material separately from said projectile.

2. A caseless cartridge as defined in claim 1 wherein said polyester film is approximately 0.005 inch thick.

* * * * *